US008375506B2

(12) United States Patent
Chaney

(10) Patent No.: US 8,375,506 B2
(45) Date of Patent: Feb. 19, 2013

(54) RECOVERY TANK ASSEMBLY HAVING A POUR SPOUT FOR AN EXTRACTOR CLEANING MACHINE

(75) Inventor: David Chaney, Northfield, OH (US)

(73) Assignee: Techtronic Floor Care Technology Limited, Road Town, Tortola (VG)

( * ) Notice: Subject to any disclaimer, the term of this patent is extended or adjusted under 35 U.S.C. 154(b) by 34 days.

(21) Appl. No.: 13/224,227

(22) Filed: Sep. 1, 2011

(65) Prior Publication Data

US 2012/0047680 A1 Mar. 1, 2012

Related U.S. Application Data

(60) Provisional application No. 61/379,200, filed on Sep. 1, 2010.

(51) Int. Cl.
*A47L 11/30* (2006.01)

(52) U.S. Cl. ..... 15/320; 15/327.2; 15/350; 15/352; 15/353; 15/410

(58) Field of Classification Search ..... 15/320, 15/327.2, 350, 352, 353, 410; *A47L 11/30*
See application file for complete search history.

(56) References Cited

U.S. PATENT DOCUMENTS

| | | | |
|---|---|---|---|
| 5,244,003 | A | 9/1993 | Boomgaarden |
| 6,125,498 | A | 10/2000 | Roberts et al. |
| 6,167,586 | B1 | 1/2001 | Reed, Jr. et al. |
| 6,167,587 | B1 | 1/2001 | Kasper et al. |
| 6,189,178 | B1 | 2/2001 | Roberts |
| 6,230,362 | B1 | 5/2001 | Kasper et al. |
| 6,279,196 | B2 | 8/2001 | Kasen et al. |
| 6,286,181 | B1 | 9/2001 | Kasper et al. |
| 6,412,141 | B2 | 7/2002 | Kasper et al. |
| 6,609,268 | B2 | 8/2003 | Miner |
| 6,880,199 | B1 | 4/2005 | Huffman et al. |
| RE39,304 | E | 9/2006 | Kasen et al. |
| 7,373,690 | B2 | 5/2008 | Sepke et al. |
| 7,377,009 | B2 | 5/2008 | Lee et al. |
| 7,475,712 | B2 | 1/2009 | McDowell |
| 7,779,505 | B2 | 8/2010 | Krebs et al. |
| 2003/0226228 | A1 | 12/2003 | Symensma et al. |
| 2009/0094782 | A1 | 4/2009 | Lenkiewicz |

FOREIGN PATENT DOCUMENTS

JP 2000201862 7/2000

OTHER PUBLICATIONS

PCT/US2011/050259 International Search Report and Written Opinion dated Apr. 9, 2011 (11 pages).
Hoover SteamVac Jr. Compact Spot Cleaner, The Hoover Company, 1996, 2 pages.

*Primary Examiner* — David Redding
(74) *Attorney, Agent, or Firm* — Michael Best & Friedrich LLP

(57) ABSTRACT

An extractor cleaning machine includes a base or foot, a handle pivotally coupled to the foot, and a suction source in fluid communication with a suction nozzle on the foot. A distributor is in fluid communication with a distribution nozzle on the foot and is operable to distribute a cleaning fluid to the surface through the distribution nozzle. A recovery tank is removably coupled to the foot and is in fluid communication with the suction source. The recovery tank receives and stores the fluid and dirt drawn through the suction nozzle when the recovery tank is in an operating position. A recovery tank handle is formed as a single unitary component with a recovery tank lid to allow a user to uncouple the recovery tank from the foot to empty the recovery tank. The recovery tank also includes a pour spout.

22 Claims, 6 Drawing Sheets

RECOVERY TANK ASSEMBLY HAVING A POUR SPOUT FOR AN EXTRACTOR CLEANING MACHINE

CROSS-REFERENCE TO RELATED APPLICATION

This application claims the benefit of and priority to U.S. Provisional Patent Application No. 61/379,200, filed Sep. 1, 2010, the entire contents of which are hereby incorporated by reference.

BACKGROUND

The present invention relates to extractor cleaning machines and, more particularly, to recovery tank assemblies for extractor cleaning machines.

Extractor cleaning machines typically include a tank for recovering liquids and dirt drawn off of a surface that is being cleaned. Over the course of cleaning, the recovery tank fills to a capacity and needs to be drained.

SUMMARY

In some embodiments, the invention provides an extractor cleaning machine including a base movable along a surface to be cleaned and including a distribution nozzle and a suction nozzle. The extractor cleaning machine also includes a handle pivotally coupled to the base to facilitate movement of the base along the surface, and a suction source in fluid communication with the suction nozzle. The suction source is operable to draw fluid and dirt from the surface through the suction nozzle. A distributor is in fluid communication with the distribution nozzle and is operable to distribute a cleaning fluid to the surface through the distribution nozzle. The extractor cleaning machine also includes a recovery tank that is removably coupled to the base and is in fluid communication with the suction source. The recovery tank receives and stores the fluid and dirt drawn through the suction nozzle when the recovery tank is in an operating position. The recovery tank includes a fluid vessel that defines an internal volume into which the fluid and dirt are received, and a lid removably coupled to the fluid vessel to provide access to the internal volume. A recovery tank handle is formed as a single unitary component with the lid to allow a user to uncouple the recovery tank from the base to move the recovery tank from the operating position to an emptying position of the recovery tank. The recovery tank handle is accessible by the user to remove the recovery tank from the base when the recovery tank is in the operating position. The recovery tank also includes a pour spout that extends outwardly from an external surface of the fluid vessel.

The recovery tank can also include a pour spout cap connectable to the pour spout to close off the pour spout. The lid can include a generally L-shaped cross section and a generally upwardly-facing surface and a generally forwardly-facing surface. The recovery tank handle can extend at an angle between the generally upwardly-facing surface and the generally forwardly-facing surface. The recovery tank handle can be positioned on a forward portion of the recovery tank when the lid is coupled to the fluid vessel, and the pour spout can be positioned at a rearward portion of the recovery tank. The pour spout can define an opening surrounded by a substantially annular wall. When the recovery tank is in the operating position the annular wall can be oriented at an angle between about 20 degrees and about 60 degrees above a horizontal axis associated with the surface to be cleaned. The recovery tank handle can define a recovery tank handle axis that is fixed relative to the fluid vessel when the lid is coupled to the fluid vessel, and an angle between the recovery tank handle axis and the annular wall can be between about 90 degrees and about 130 degrees. The handle can be moveable between an upright storage position and a plurality of inclined operating position, and the pour spout can be hidden from view when the recovery tank is in the operating position and the handle is in the upright storage position. The pour spout can be positioned and oriented such that when the recovery tank handle axis is substantially horizontal, the pour spout is approximately level with or below a lowest point of the internal volume.

In other embodiments, the invention provides an extractor cleaning machine including a base that is movable along a surface to be cleaned and that includes a distribution nozzle and a suction nozzle. A handle is pivotally coupled to the base to facilitate movement of the base along the surface. A suction source is coupled to one of the base and the handle and is in fluid communication with the suction nozzle. A distributor is in fluid communication with the distribution nozzle and is operable to distribute a cleaning fluid to the surface through the distribution nozzle. The extractor cleaning machine also includes a recovery tank that is removably coupled to the base and is in fluid communication with the suction source to receive material drawn through the suction nozzle when the recovery tank is in an operating position. The recovery tank includes a fluid vessel that defines an internal volume into which the fluid and dirt are received, and a lid removably coupled to the fluid vessel to provide access to the internal volume. The lid includes a generally forwardly-facing surface, a generally upwardly-facing surface, and an integrally-formed recovery tank handle that is fixed relative to the lid. The recovery tank handle extends in a longitudinal direction between the forwardly-facing surface and the upwardly-facing surface, and defines a recovery tank handle axis. The recovery tank also includes a pour spout extending outwardly from an external surface of the fluid vessel and substantially laterally aligned with the recovery tank handle axis.

The recovery tank handle can extend at an angle between the generally upwardly-facing surface and the generally forwardly-facing surface. The recovery tank handle can be positioned on a forward portion of the recovery tank when the lid is coupled to the fluid vessel, and the pour spout can be positioned at a rearward portion of the recovery tank. The pour spout can define an opening surrounded by a substantially annular wall. When the recovery tank is in the operating position the annular wall can be oriented at an angle between about 20 degrees and about 60 degrees above a horizontal axis associated with the surface to be cleaned. An angle between the recovery tank handle axis and the annular wall can be between about 90 degrees and about 130 degrees. The handle can be moveable between an upright storage position and a plurality of inclined operating positions, and the pour spout can be hidden from view when the recovery tank is in the operating position and the handle is in the upright storage position. The pour spout can be positioned and oriented such that when the recovery tank handle axis is substantially horizontal, the pour spout is approximately level with or below a lowest point of the internal volume.

In still other embodiments, the invention provides an extractor cleaning machine including a base that is movable along a surface to be cleaned and that includes a distribution nozzle and a suction nozzle. A handle is pivotally coupled to the base to facilitate movement of the base along the surface. A suction source is coupled to one of the base and the handle and is in fluid communication with the suction nozzle. A distributor is in fluid communication with the distribution nozzle and is operable to distribute a cleaning fluid to the surface through the distribution nozzle. A recovery tank is removably coupled to the base and is in fluid communication with the suction source to receive material drawn through the suction nozzle when the recovery tank is in an operating position. The recovery tank includes a fluid vessel defining an internal volume into which the fluid and dirt are received, and a lid removably coupled to the fluid vessel to provide access to the internal volume. The lid includes a generally forwardly-facing surface, a generally upwardly-facing surface, and an integrally-formed recovery tank handle that is fixed relative to the lid and that extends at an angle and in a longitudinal direction between the forwardly-facing surface and the upwardly-facing surface. The recovery tank handle defines a recovery tank handle axis. The recovery tank also includes a pour spout that extends outwardly from an external surface of the fluid vessel and that is substantially laterally aligned with the recovery tank handle axis. The pour spout defines an opening that is surrounded by a substantially annular wall, and an angle between the recovery tank handle axis and the annular wall is between about 90 degrees and about 130 degrees.

When the recovery tank is in the operating position the annular wall can be oriented at an angle between about 20 degrees and about 60 degrees above a horizontal axis associated with the surface to be cleaned. The handle can be moveable between an upright storage position and a plurality of inclined operating position, and the pour spout can be hidden from view when the recovery tank is in the operating position and the handle is in the upright storage position. The recovery tank handle can be positioned on a forward portion of the recovery tank when the lid is coupled to the fluid vessel, and the pour spout can be positioned at a rearward portion of the recovery tank. The pour spout can be positioned and oriented such that when the recovery tank handle axis is substantially horizontal, the pour spout is approximately level with or below a lowest point of the internal volume.

Before any embodiments of the invention are explained in detail, it is to be understood that the invention is not limited in its application to the details of construction and the arrangement of components set forth in the following description or illustrated in the above-described drawings. The invention is capable of other embodiments and of being practiced or of being carried out in various ways.

DETAILED DESCRIPTION

Figure 1:
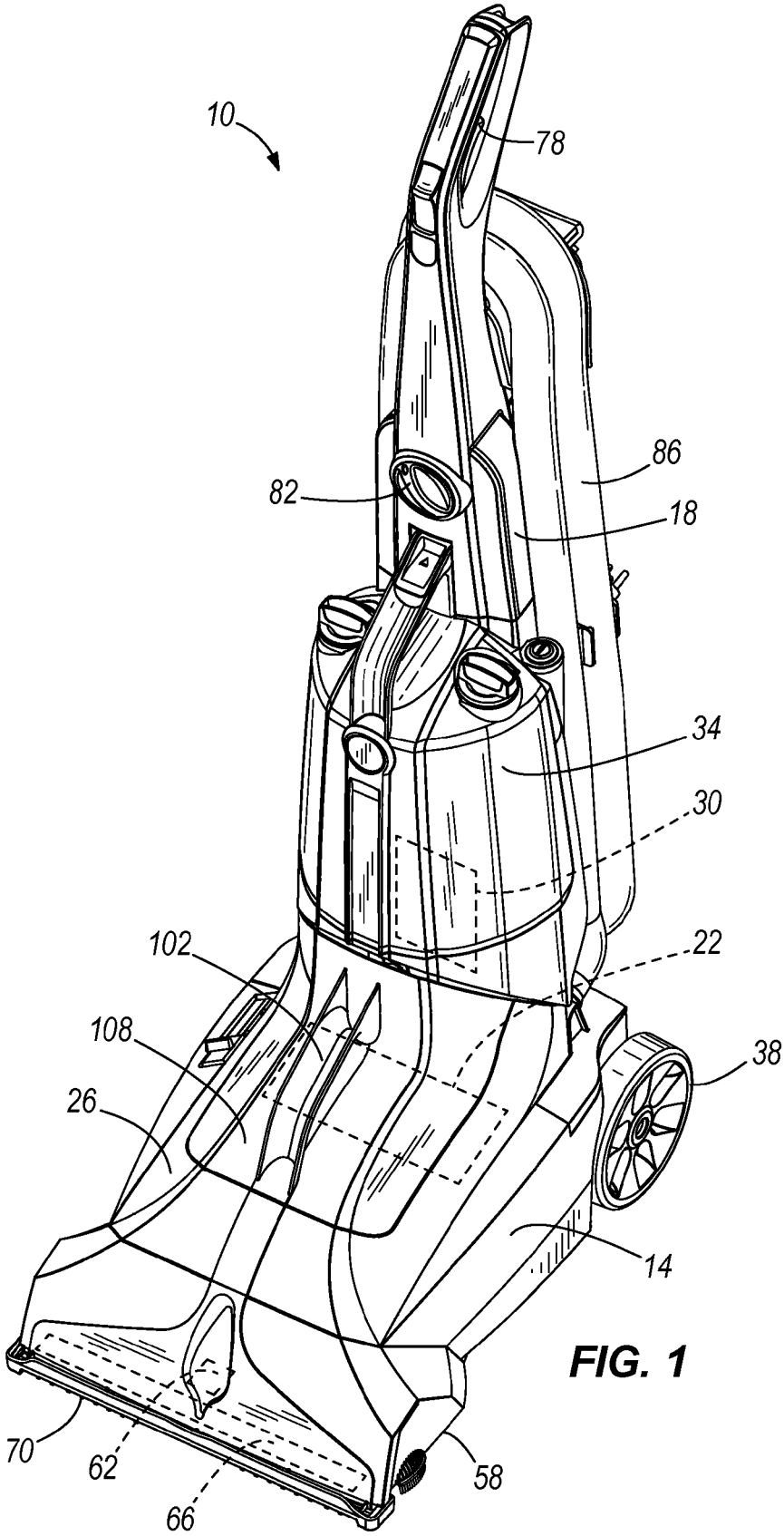
FIG. 1 is a perspective view of an extractor cleaning machine embodying the invention.

FIG. 1 illustrates an extractor cleaning machine 10 (hereinafter referred to simply as an "extractor"). In the illustrated embodiment, the extractor 10 is an upright extractor operable to clean a surface, such as, for example, a floor. In some embodiments, the extractor 10 may be adapted to clean a variety of surfaces, such as carpets, hardwood floors, tiles, or the like. The extractor 10 distributes or sprays a cleaning fluid (e.g., water, detergent, or a mixture of water and detergent) onto the surface to clean the surface. The extractor 10 then draws the cleaning fluid and any dirt off of the surface, leaving the surface relatively clean and dry.

The illustrated extractor 10 includes a base in the form of a foot 14 (other, non-upright-type extractors might include a different type of base), a handle 18 coupled to the foot 14, a suction source 22 supported by the foot 14, a recovery tank 26 coupled to the foot 14, a distributor 30 supported by the handle 18, and a supply tank assembly 34 coupled to the handle 18. In the illustrated embodiment, the suction source 22 is generally underneath the recovery tank 26. In other embodiments, the suction source 22 may be supported by the handle 18 or may be positioned elsewhere on the extractor 10.

The foot 14 is movable along the surface to be cleaned and supports the other components of the extractor 10. Two wheels 38 (only one of which is shown in FIG. 1) are coupled to the foot 14 to facilitate movement of the foot 14 along the surface. In the illustrated embodiment, the wheels 38 are idle wheels. In other embodiments, the wheels 38 may be driven wheels.

Figure 2:
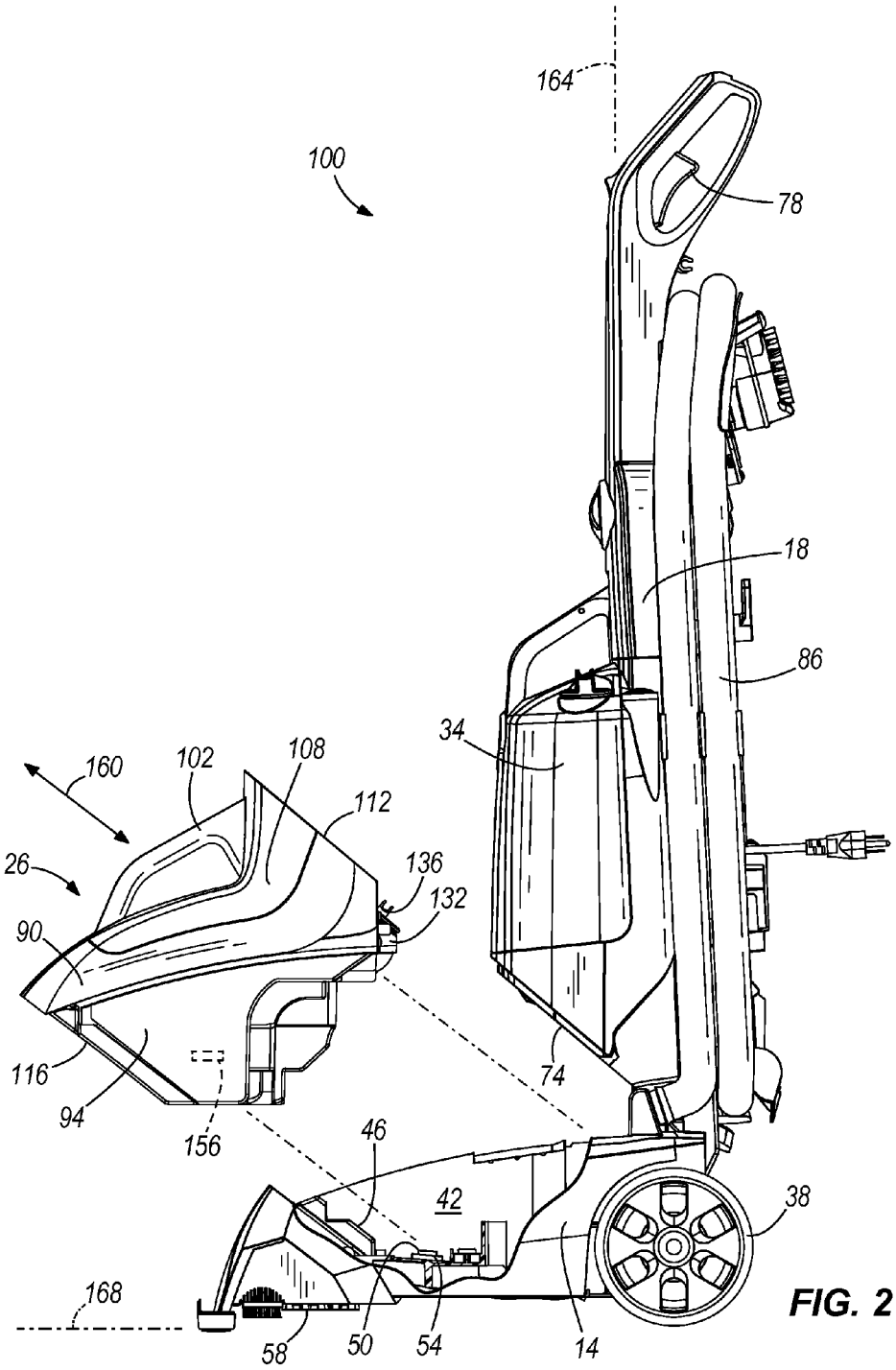
FIG. 2 is a cutaway side view of the extractor cleaning machine of FIG. 1 with a recovery tank of the extractor cleaning machine exploded.
Figure 3:
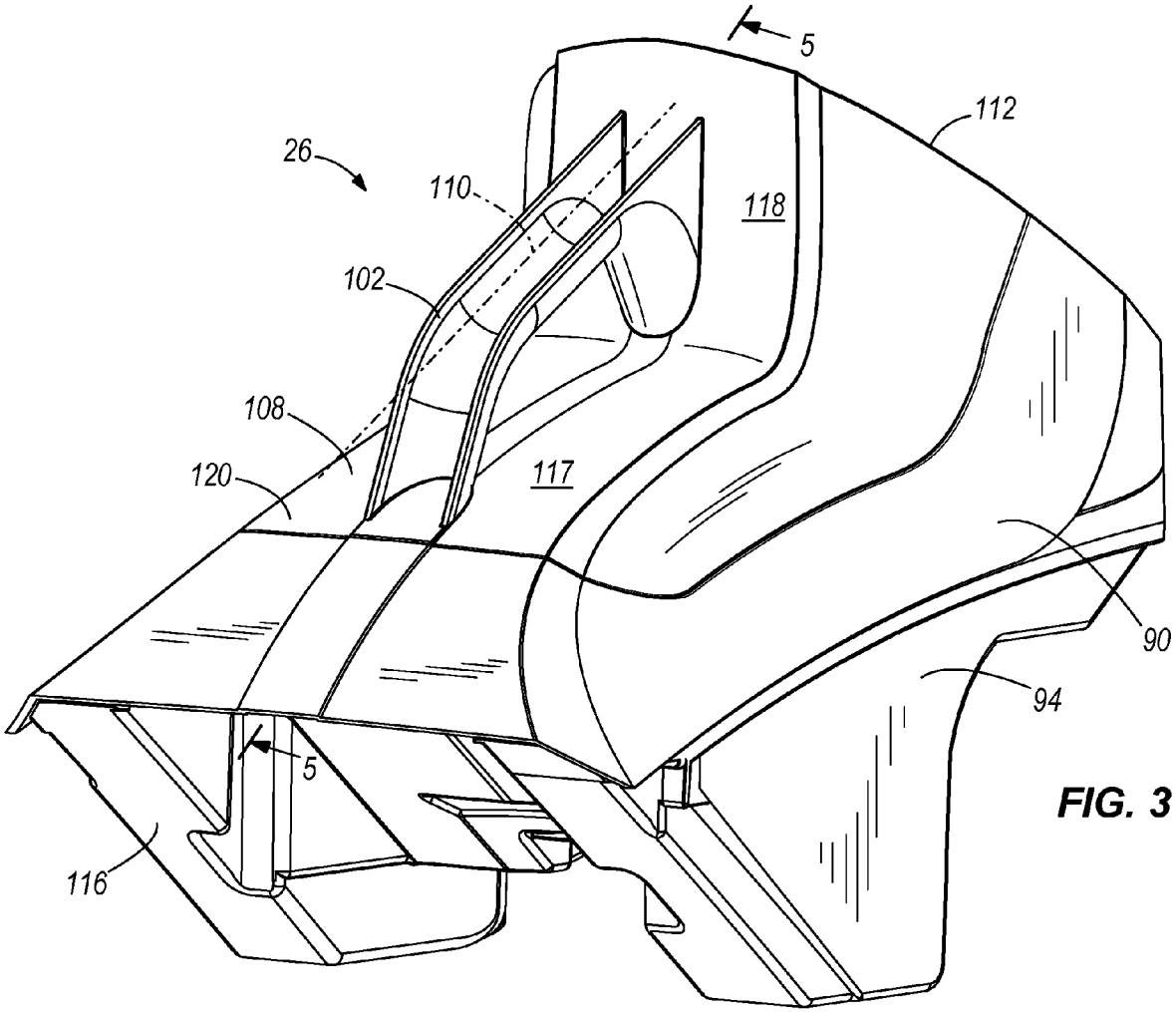
FIG. 3 is a front perspective view of the recovery tank of the extractor cleaning machine of FIG. 1.

As shown in FIG. 2, a cavity 42 is formed in the foot 14 to receive the recovery tank 26. The cavity 42 is configured with a plurality of internal surfaces 46. A magnet 50 is positioned within the cavity 42 and coupled to a first ferromagnetic plate 54.

Referring back to FIG. 1, the foot 14 further includes a distribution nozzle 62, a suction nozzle 66, and a brush assembly 70 adjacent a lower surface 58 of the foot. The distribution nozzle 62 directs cleaning fluid toward the surface to be cleaned. The suction nozzle 66 draws fluid and dirt from the surface back into the recovery tank 26 of the extractor 10. The brush assembly 70 is coupled to the lower surface 58 adjacent the distribution and suction nozzles 62 and 66 to scrub the surface. The brush assembly 70 also helps inhibit fluid from flowing beyond a periphery of the foot 14. In some embodiments, individual brushes of the brush assembly 70 may be electrically or pneumatically rotated to agitate and scrub the surface.

The suction source 22 is in fluid communication with the suction nozzle 66 to draw fluid and dirt from the surface through the suction nozzle 66. In one embodiment, the suction source 22 includes a fan that generates a vacuum to draw the fluid and dirt through the suction nozzle 66.

The distributor 30 is in fluid communication with the distribution nozzle 62 to draw cleaning fluid from the supply tank assembly 34 and distribute the fluid to the surface through the distribution nozzle 62. The illustrated distributor 30 draws two separate cleaning fluids (e.g., water and detergent) from the supply tank assembly 34, mixes the fluids, and distributes the mixed cleaning fluid onto the surface. In some embodiments, the distributor 30 may include a pump that propels the cleaning fluid to the distribution nozzle 62. In the illustrated embodiment, the distributor 30 is supported by the handle 18 generally behind the supply tank assembly 34. In other embodiments, the distributor 30 may be supported by the foot 14 or may be positioned elsewhere on the extractor 10.

The illustrated handle 18 is pivotally coupled to and extends from the foot 14. The handle 18 is pivotable or tiltable relative to the foot 14 from a generally vertical, or upright, storage position shown in FIG. 1 to an infinite number of non-vertical, or inclined, operating positions. Pivoting the handle 18 to an operating position facilitates moving the foot 14 along the surface. As shown in FIG. 2, the handle includes an inclined lower handle surface 74 that is positioned opposite the recovery tank 26 when the recovery tank is installed in the cavity 42.

As shown in FIGS. 1 and 2, the handle 18 supports a trigger 78 and a mode knob 82. The trigger 78 is actuatable to spray cleaning fluid from the supply tank assembly 34 through the distributor 30 and the distribution nozzle 62 and onto the surface. The mode knob 82 adjusts the operating mode (i.e., wash, rinse, auto-rinse, etc.) of the extractor 10. The illustrated handle 18 also supports an accessory hose 86. The accessory hose 86 is connectable to a variety of hand-held tools to help clean smaller surfaces, such as, for example, steps.

As shown in FIGS. 2-6, the recovery tank 26 includes an upper portion 90 and a lower portion 94. The upper portion 90 and lower portion 94 define an internal volume 98 (FIG. 5) into which dirt and liquids are received (i.e. "recovered") via the suction nozzle 66 by an airflow generated by the suction source 22. A recovery tank handle 102 is positioned on a forward portion of the recovery tank 26. The handle 102 is integrally formed with and fixed relative to a detachable recovery tank lid 108 as a single component. The handle 102 defines a recovery tank handle axis 110 and is positioned between an upper surface 112 and a lower surface 116 of the recovery tank 26. The recovery tank lid 108 includes a generally L-shaped cross section (see FIG. 5) defined by a generally upwardly-facing surface 117 and a generally forwardly-facing surface 118. The handle 102 and thus the handle axis 110 extend in a longitudinal direction at an angle relative to the horizontal between the generally upwardly-facing surface 117 and the generally forwardly-facing surface 118. In other embodiments, the handle 102 may be separately formed from the recovery tank lid 108, or coupled to another part of the recovery tank 26. A front portion 120 of the recovery tank lid 108 includes hooks or tabs 122 (FIG. 5) that engage the recovery tank upper portion 90.

Figure 4:
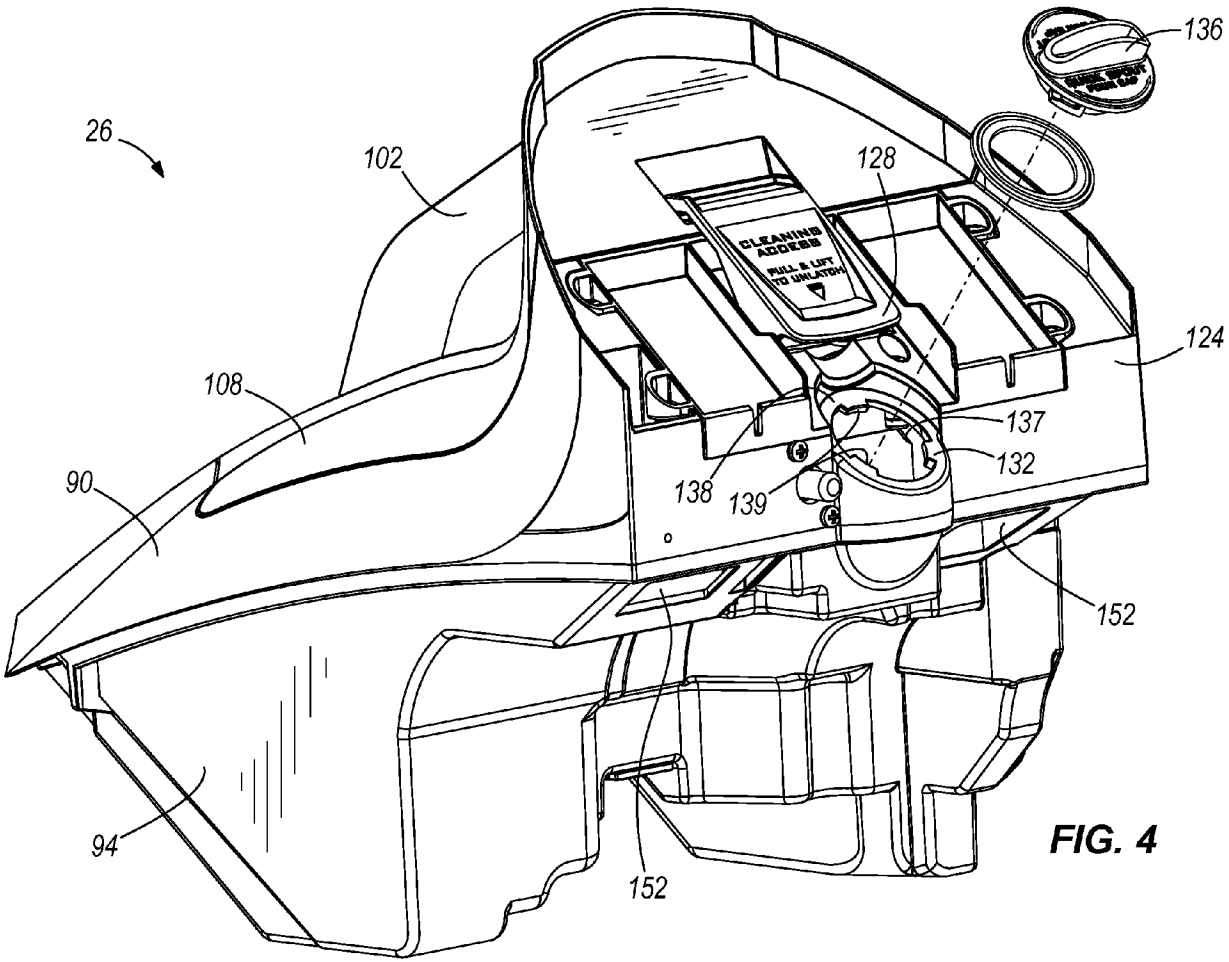
FIG. 4 is a rear partially exploded perspective view of the recovery tank of FIG. 3.

FIG. 4 best illustrates additional features on a rear portion 124 of the recovery tank 26, including a lid latch 128 and a pour spout 132. The lid latch 128 is provided to selectively couple the recovery tank lid 108 to the upper portion 90 of the recovery tank 26. In the illustrated embodiment, the lid latch 128 is an over-center type latch. In combination with the tabs 122 on the front portion 120, the lid latch 128 provides for selective detachment of the recovery tank lid 108 from the upper portion 90 in order to provide internal access to the internal volume 98 of the recovery tank 26 for cleaning and repair.

The pour spout 132 is formed in part by a bulbous projection that extends outwardly from the rear portion 124 of the recovery tank 26, and is provided with a pour spout cap 136. The pour spout 132 defines an opening 137 that is surrounded by a substantially annular wall 138. In the illustrated construction, the annular wall 138 includes tabs 139 for engagement with the pour spout cap 136 to secure the pour spout cap 136 to the pour spout 132. The pour spout cap 136 is provided to close off the pour spout 132 when the recovery tank 26 is installed in the cavity 62 and when carrying the recovery tank 26 to a point of disposal. The pour spout cap 136 may be threaded into the pour spout, may be a frictional fit, or may use substantially any other suitable configuration. In the illustrated embodiment, the pour spout cap 136 is a quick engagement type that engages the tabs 139 of the annular wall 138 and requires less than 90 degrees rotation between engagement and disengagement.

With the recovery tank 26 in an emptying position, (i.e., separated from the extractor 10), the pour spout 132 allows the recovery tank 26 to be drained into a point of disposal such as a sink, tub, or other disposal basin. In the illustrated embodiment, the pour spout 132 is integrally formed as one with the upper portion 90 of the recovery tank 26. The pour spout 132 projects outwardly from the rear portion 124 of the recovery tank 26 and is configured to pour out the contents of the recovery tank 26 without substantial dripping or spillage. The position of the pour spout 132 at the rear portion 124 of the recovery tank 26 is substantially opposite the handle 102, such that a user may drain the recovery tank 26 with one hand. Moreover, with reference to FIG. 5, the pour spout 132 is positioned and oriented such that when the handle 102 is rotated to position the handle axis 110 in a substantially horizontal orientation, the pour spout 132 is approximately level with or below the lowest point in the internal volume 98 of the recovery tank 26. This configuration greatly simplifies emptying the recovery tank 26 because it allows the recovery tank 26 to be emptied with one hand and with a minimal amount of wrist flexion on the part of the user.

As illustrated in FIG. 2, the recovery tank 26 is removably coupled to the cavity 42 formed in the foot 14. The recovery tank handle 102 facilitates removing and handling the tank 26 apart from the foot 14. When installed in the cavity 42, or in an operating position, the recovery tank 26 is in fluid communication with the suction source 22 and the suction nozzle 66 to receive and store the fluid and dirt drawn through the nozzle 66. Also, when the recovery tank 26 is installed in the operating position and the handle 18 is in the upright storage position, the pour spout 132 is hidden from view.

Figure 5:
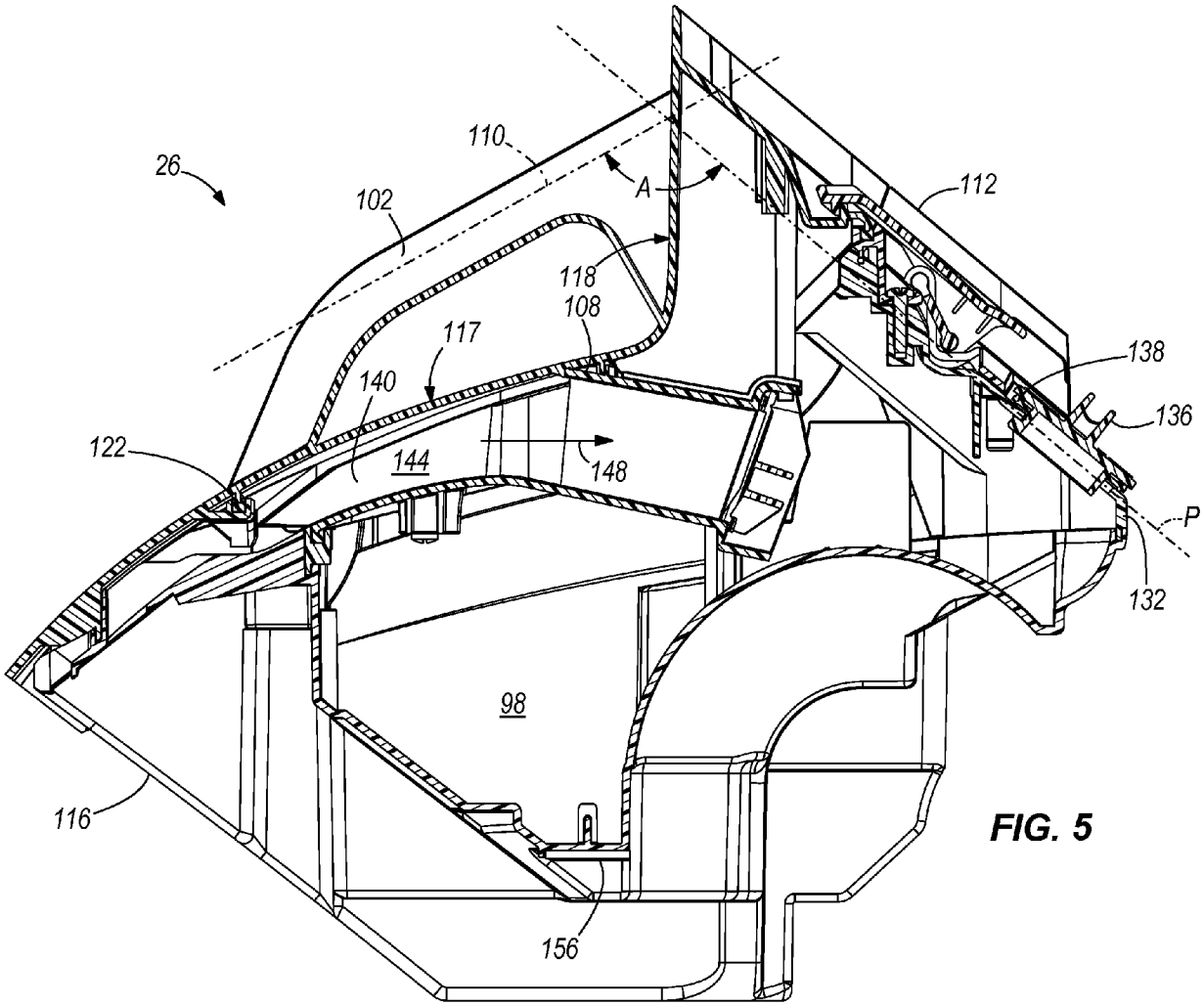
FIG. 5 is a sectional view along line 5-5 of the recovery tank of FIG. 3.

FIG. 5 illustrates the internal configuration of the recovery tank 26. The recovery tank lid 108 includes an air/water separator 140 that defines a conduit 144. A high velocity mixed (air and water) stream from the suction nozzle 66 enters the conduit 144. The conduit 144 increases in cross sectional area in a direction of flow 148. The increasing cross-sectional area slows down the mixed stream, allowing higher-density liquids to drop out and separate from the air stream. Drains are provided in the conduit 144 so that the liquids may collect in the recovery tank 26. Air discharged from the separator 140 has a substantially reduced moisture content, allowing for subsequent filtration and exhaust in other portions of the extractor 10. The conduit 144 exhausts through ports 152 (FIG. 4) at the rear portion 124 of the recovery tank 26.

Figure 6:
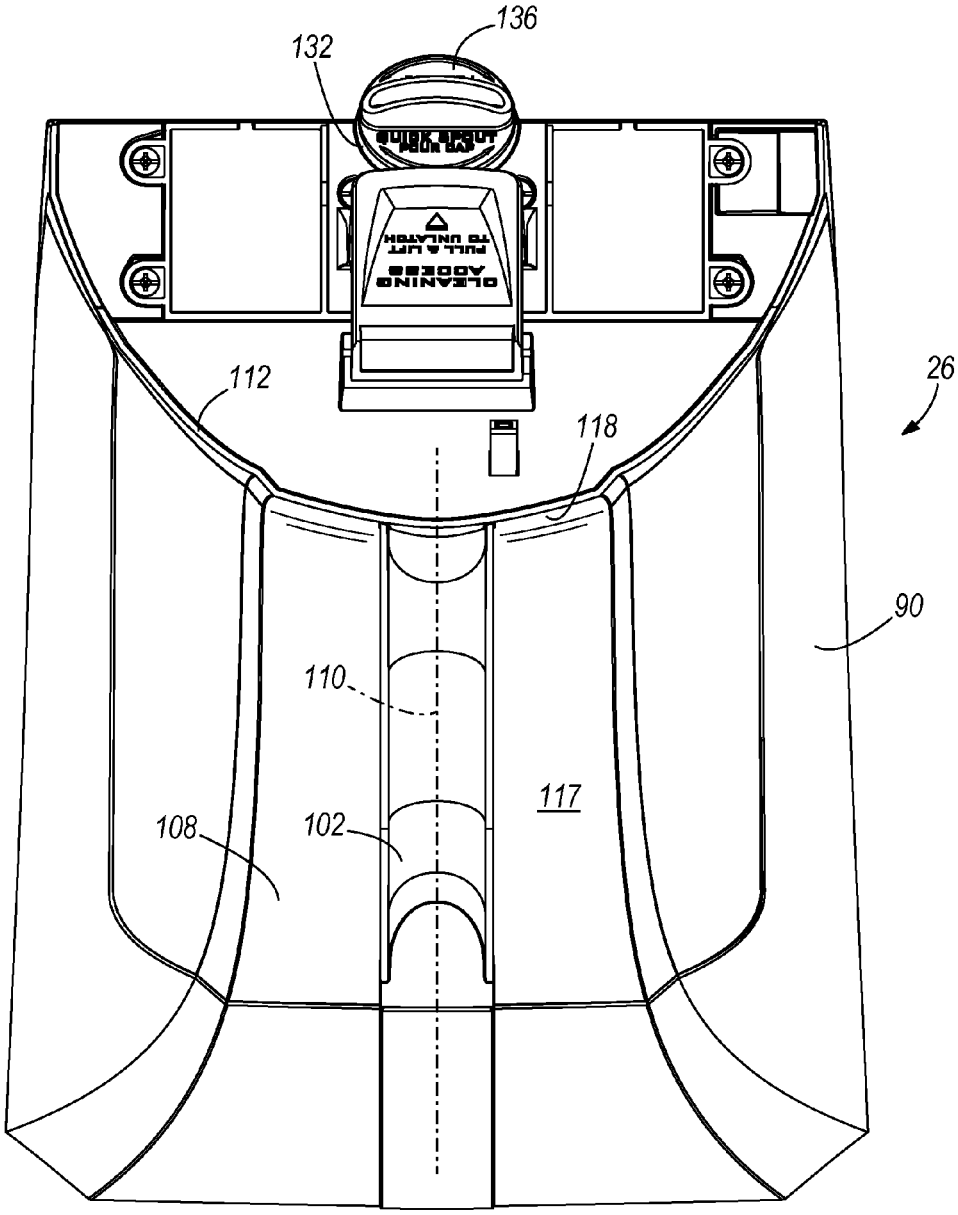
FIG. 6 is a top view of the recovery tank of FIG. 3.

FIGS. 5 and 6 also illustrate that the recovery tank handle 102 and handle axis 110 are substantially laterally aligned with the pour spout 132. That is, the handle 102 and pour spout 132 are located in substantially the same vertical plane (e.g., the viewing plane in FIG. 5), which plane also extends through the handle axis 110. This alignment and the relative angles between the handle 102 and the annular wall 138 of the pour spout 132 improve the ergonomics of emptying of the recovery tank 26 with one hand and help to reduce dripping or spillage.

With reference to FIG. 5, in the illustrated embodiment, an angle A between the handle axis 110 and a plane P defined by the annular wall 138 is about 110 degrees. In other embodiments, the angle A may be between about 100 degrees and about 120 degrees. In still other embodiments, the angle A may be between about 90 degrees and about 130 degrees. Also in the illustrated embodiment, the annular wall 138 and the plane P are oriented at an angle of about 40 degrees above a horizontal axis 168 defined by the foot (or a floor surface, see FIG. 2). In other embodiments, the annular wall 138 may be oriented at an angle of between about 30 degrees and about 50 degrees above the horizontal axis 168. In still other embodiments, the annular wall 138 may be oriented at an angle of between about 20 degrees and about 60 degrees above the horizontal axis 168. With reference to FIG. 6, although the handle axis 110 is shown as extending directly toward the pour spout 132 (e.g., the axis 110 is substantially vertical in FIG. 6), the handle axis 110 could also be angled to the right or left if desired.

As shown in FIGS. 2 and 5, a second ferromagnetic plate 156 is coupled to a bottom portion of the recovery tank 26. The ferromagnetic plates 54 and 156 are attracted to the magnet 50 to assist in providing consistent alignment between the recovery tank 26 and foot 14.

The magnet 50 and ferromagnetic plates 54 and 156 provide a more secure connection between the recovery tank 26 and the foot 14, but yet allow a user to remove the recovery tank 26 without having to operate a latch or the like. The more secure connection is desired so that the recovery tank 26 does not move or shift during operation of the extractor 10 or when the handle 18 is pivoted to the upright position. Movement of the recovery tank 26 during operation is undesirable because the recovery tank 26 is mechanically linked to other portions of the extractor 10. If the recovery tank 26 moves during operation, these connections may be compromised. In other embodiments, additional magnets may be provided, such as an opposing magnet on the recovery tank instead of a ferromagnetic plate.

FIG. 2 illustrates a feature of the extractor 10 that allows for removal and insertion of the recovery tank 26 from the cavity 42 of the foot 14 without tilting the handle 18 from the illustrated upright position. The recovery tank 26 may be conveniently removed and inserted along an insertion axis 160 between a vertical axis 164, defined by the upright handle 18, and the horizontal axis 168 defined by the foot (or a floor surface). As shown in FIG. 2, the lower surface 74 of the handle 18 is substantially parallel to the insertion axis 160 when the handle 18 is upright. Similarly, the internal surfaces 46 of the cavity 42 are substantially parallel to the insertion axis 160. The upper surface 112 and the lower surface 116 of the recovery tank 26 are also substantially parallel to the insertion axis 160 during removal, insertion and use. The configuration of the recovery tank 26, in combination with the configuration of the cavity 42 allows for convenient insertion and removal without repositioning the handle 18 relative to the foot 14.

Although the invention has been described in detail with reference to certain preferred embodiments, variations and modifications exist within the scope and spirit of one or more independent aspects of the invention as described.

Various features and advantages of the invention are set forth in the following claim.

What is claimed is:

1. An extractor cleaning machine comprising:

a base movable along a surface to be cleaned, the base including a distribution nozzle and a suction nozzle;

a handle pivotally coupled to the base to facilitate movement of the base along the surface;

a suction source in fluid communication with the suction nozzle, the suction source operable to draw fluid and dirt from the surface through the suction nozzle;

a distributor in fluid communication with the distribution nozzle, the distributor operable to distribute a cleaning fluid to the surface through the distribution nozzle; and a recovery tank removably coupled to the base and in fluid communication with the suction source to receive and store the fluid and dirt drawn through the suction nozzle when the recovery tank is in an operating position, the recovery tank including a fluid vessel defining an internal volume into which the fluid and dirt are received, a lid removably coupled to the fluid vessel to provide access to the internal volume, a recovery tank handle formed as a single unitary component with the lid to allow a user to uncouple the recovery tank from the base to move the recovery tank from the operating position to an emptying position of the recovery tank, the recovery tank handle being accessible by the user to remove the recovery tank from the base when the recovery tank is in the operating position, and a pour spout extending outwardly from an external surface of the fluid vessel.

2. The extractor cleaning machine of claim 1, wherein the recovery tank further includes a pour spout cap connectable to the pour spout to close off the pour spout.

3. The extractor cleaning machine of claim 1, wherein the lid includes a generally L-shaped cross section and includes a generally upwardly-facing surface and a generally forwardly-facing surface, and wherein the recovery tank handle extends at an angle between the generally upwardly-facing surface and the generally forwardly-facing surface.

4. The extractor cleaning machine of claim 1, wherein the recovery tank handle is positioned on a forward portion of the recovery tank when the lid is coupled to the fluid vessel, and wherein the pour spout is positioned at a rearward portion of the recovery tank.

5. The extractor cleaning machine of claim 1, wherein the pour spout defines an opening surrounded by a substantially annular wall.

6. The extractor cleaning machine of claim 5, wherein when the recovery tank is in the operating position the annular wall is oriented at an angle between about 20 degrees and about 60 degrees above a horizontal axis associated with the surface to be cleaned.

7. The extractor cleaning machine of claim 5, wherein the recovery tank handle defines a recovery tank handle axis that is fixed relative to the fluid vessel when the lid is coupled to the fluid vessel, and wherein an angle between the recovery tank handle axis and the annular wall is between about 90 degrees and about 130 degrees.

8. The extractor cleaning machine of claim 1, wherein the handle is moveable between an upright storage position and a plurality of inclined operating position, and wherein the pour spout is hidden from view when the recovery tank is in the operating position and the handle is in the upright storage position.

9. The extractor cleaning machine of claim 1, wherein the recovery tank handle defines a recovery tank handle axis, and wherein the pour spout is positioned and oriented such that when the recovery tank handle axis is substantially horizontal, the pour spout is approximately level with or below a lowest point of the internal volume.

10. An extractor cleaning machine comprising:

a base movable along a surface to be cleaned, the base including a distribution nozzle and a suction nozzle;

a handle pivotally coupled to the base to facilitate movement of the base along the surface;

a suction source coupled to one of the base and the handle and in fluid communication with the suction nozzle;

a distributor in fluid communication with the distribution nozzle, the distributor operable to distribute a cleaning fluid to the surface through the distribution nozzle; and a recovery tank removably coupled to the base and in fluid communication with the suction source to receive material drawn through the suction nozzle when the recovery tank is in an operating position, the recovery tank including a fluid vessel defining an internal volume into which the fluid and dirt are received, a lid removably coupled to the fluid vessel to provide access to the internal volume, the lid including a generally forwardly-facing surface, a generally upwardly-facing surface, and an integrally-formed recovery tank handle that is fixed relative to the lid and that extends in a longitudinal direction between the forwardly-facing surface and the upwardly-facing surface, the recovery tank handle defining a recovery tank handle axis; and a pour spout extending outwardly from an external surface of the fluid vessel and substantially laterally aligned with the recovery tank handle axis.

11. The extractor cleaning machine of claim 10, wherein the recovery tank handle extends at an angle between the generally upwardly-facing surface and the generally forwardly-facing surface.

12. The extractor cleaning machine of claim 10, wherein the recovery tank handle is positioned on a forward portion of the recovery tank when the lid is coupled to the fluid vessel, and wherein the pour spout is positioned at a rearward portion of the recovery tank.

13. The extractor cleaning machine of claim 10, wherein the pour spout defines an opening surrounded by a substantially annular wall.

14. The extractor cleaning machine of claim 13, wherein when the recovery tank is in the operating position the annular wall is oriented at an angle between about 20 degrees and about 60 degrees above a horizontal axis associated with the surface to be cleaned.

15. The extractor cleaning machine of claim 13, wherein an angle between the recovery tank handle axis and the annular wall is between about 90 degrees and about 130 degrees.

16. The extractor cleaning machine of claim 10, wherein the handle is moveable between an upright storage position and a plurality of inclined operating positions, and wherein the pour spout is hidden from view when the recovery tank is in the operating position and the handle is in the upright storage position.

17. The extractor cleaning machine of claim 10, wherein the pour spout is positioned and oriented such that when the recovery tank handle axis is substantially horizontal, the pour spout is approximately level with or below a lowest point of the internal volume.

18. An extractor cleaning machine comprising:

a base movable along a surface to be cleaned, the base including a distribution nozzle and a suction nozzle;

a handle pivotally coupled to the base to facilitate movement of the base along the surface;

a suction source coupled to one of the base and the handle and in fluid communication with the suction nozzle;

a distributor in fluid communication with the distribution nozzle, the distributor operable to distribute a cleaning fluid to the surface through the distribution nozzle; and a recovery tank removably coupled to the base and in fluid communication with the suction source to receive material drawn through the suction nozzle when the recovery tank is in an operating position, the recovery tank including a fluid vessel defining an internal volume into which the fluid and dirt are received, a lid removably coupled to the fluid vessel to provide access to the internal volume, the lid including a generally forwardly-facing surface, a generally upwardly-facing surface, and an integrally-formed recovery tank handle that is fixed relative to the lid and that extends at an angle and in a longitudinal direction between the forwardly-facing surface and the upwardly-facing surface, the recovery tank handle defining a recovery tank handle axis; and a pour spout extending outwardly from an external surface of the fluid vessel and substantially laterally aligned with the recovery tank handle axis, the pour spout defining an opening surrounded by a substantially annular wall, wherein an angle between the recovery tank handle axis and the annular wall is between about 90 degrees and about 130 degrees.

19. The extractor cleaning machine of claim 18, wherein when the recovery tank is in the operating position the annular wall is oriented at an angle between about 20 degrees and about 60 degrees above a horizontal axis associated with the surface to be cleaned.

20. The extractor cleaning machine of claim 18, wherein the handle is moveable between an upright storage position and a plurality of inclined operating position, and wherein the pour spout is hidden from view when the recovery tank is in the operating position and the handle is in the upright storage position.

21. The extractor cleaning machine of claim 18, wherein the recovery tank handle is positioned on a forward portion of the recovery tank when the lid is coupled to the fluid vessel, and wherein the pour spout is positioned at a rearward portion of the recovery tank.

22. The extractor cleaning machine of claim 18, wherein the pour spout is positioned and oriented such that when the recovery tank handle axis is substantially horizontal, the pour spout is approximately level with or below a lowest point of the internal volume.

* * * * *